US009341064B2

(12) United States Patent
Kwak et al.

(10) Patent No.: US 9,341,064 B2
(45) Date of Patent: May 17, 2016

(54) VANE ROTARY COMPRESSOR HAVING A HINGE-COUPLED VANE

(75) Inventors: Jung Myung Kwak, Daejeon (KR); Seon Joo Hong, Daejeon (KR); Kweon Soo Lim, Daejeon (KR); In Cheol Shin, Daejeon (KR)

(73) Assignee: Hanon Systems, Daejeon-si (KR)

( * ) Notice: Subject to any disclaimer, the term of this patent is extended or adjusted under 35 U.S.C. 154(b) by 12 days.

(21) Appl. No.: 14/233,846

(22) PCT Filed: Jul. 20, 2012

(86) PCT No.: PCT/KR2012/005814

§ 371 (c)(1),
(2), (4) Date: Jan. 20, 2014

(87) PCT Pub. No.: WO2013/015575

PCT Pub. Date: Jan. 31, 2013

(65) Prior Publication Data

US 2014/0170010 A1 Jun. 19, 2014

(30) Foreign Application Priority Data

Jul. 22, 2011 (KR) ..... 10-2011-0072990
Jul. 18, 2012 (KR) ..... 10-2012-0078115

(51) Int. Cl.
*F03C 4/00* (2006.01)
*F04C 2/00* (2006.01)
*F04C 18/00* (2006.01)
(Continued)

(52) U.S. Cl.
CPC . *F01C 21/10* (2013.01); *F01C 1/44* (2013.01); *F01C 21/106* (2013.01); *F04C 2/44* (2013.01); *F04C 18/344* (2013.01); *F04C 29/065* (2013.01); *F04C 29/066* (2013.01)

(58) Field of Classification Search
CPC ..... F04C 2/344; F04C 2/3446; F04C 2/44; F04C 18/344; F04C 29/065; F04C 29/066; F01C 21/08; F01C 21/0809; F01C 21/0836; F01C 1/44
USPC ..... 418/76, 79, 82, 93, 259–260, 266–268
See application file for complete search history.

(56) References Cited

U.S. PATENT DOCUMENTS 1,116,781 A * 11/1914 Amey ..... 418/260
3,873,246 A 3/1975 Hansen
(Continued)

FOREIGN PATENT DOCUMENTS

CN 2644711 Y 9/2004
JP 2002130169 A 5/2002
(Continued)

*Primary Examiner* — Theresa Trieu
(74) *Attorney, Agent, or Firm* — Fraser Clemens Martin & Miller LLC; James D. Miller

(57) ABSTRACT

The present invention relates to a vane rotary compressor in which, while a rotor is rotating, the volume of a compressing chamber is reduced and a fluid such as a refrigerant is compressed. The vane rotary compressor according to one embodiment of the present invention is provided with the compressing chamber, the inner circumferential surface of which is formed in the shape of an involute curve, wherein the rotor is hinge-coupled with a plurality of cantilever vanes such that compression efficiency is high and noise is prevented from occurring during the operation of the compressor.

14 Claims, 9 Drawing Sheets

(51) Int. Cl.

| | |
|---|---|
| ***F01C 21/10*** | (2006.01) |
| ***F01C 1/44*** | (2006.01) |
| ***F04C 2/44*** | (2006.01) |
| ***F04C 29/06*** | (2006.01) |
| ***F04C 18/344*** | (2006.01) |

(56) References Cited

U.S. PATENT DOCUMENTS 4,666,386 A * 5/1987 Winkler et al. ..... 418/267
5,411,385 A * 5/1995 Eto et al. ..... 418/96
7,736,139 B2 * 6/2010 Sorby ..... 418/268

FOREIGN PATENT DOCUMENTS

| | | | |
|---|---|---|---|
| JP | 2009007937 | A | 1/2009 |
| JP | 2010031759 | A | 2/2010 |
| KR | 1020050118392 | A | 12/2005 |
| KR | 100589184 | A | 12/2006 |

* cited by examiner

VANE ROTARY COMPRESSOR HAVING A HINGE-COUPLED VANE

TECHNICAL FIELD

The present invention relates to a vane rotary compressor in which a fluid such as refrigerant is compressed while a volume of a compression chamber is reduced during rotation of a rotor, and more particularly, to a vane rotary compressor including a compression chamber which an inner peripheral surface thereof is formed in the form of an involute curve, wherein the rotor is hinge-coupled with a plurality of cantilever vanes.

BACKGROUND ART

A vane rotary compressor is used for an air conditioner and the like and compresses a fluid such as refrigerant so as to supply the compressed fluid to the outside.

FIG. 1 is a cross-sectional view schematically illustrating a conventional vane rotary compressor disclosed in Japanese Unexamined Patent Application Publication No. 2009-07937 (Patent Document 1). FIG. 2 is a cross-sectional view taken along line A-A in FIG. 1.

As shown in FIGS. 1 and 2, the conventional vane rotary compressor includes a hollow cylinder 1, a rotor 2 installed within the cylinder 1, a vane 4 slidably inserted into a vane slot 3 of the rotor 2, a rotary shaft 5 formed integrally with the rotor 2 to be axially rotatably supported, and a front cover 6 and a rear cover 7 which close both ends of the cylinder 1 to define a compression chamber 8.

In this case, the compression chamber 8 communicates with an inlet 9 and an outlet 10, the outlet 10 is provided with a discharge valve 11, and the rear cover 7 is formed with a high pressure passage 12 so as to communicate with a high pressure chamber in a rear housing 13 mounted on a rear surface of the rear cover 7.

Meanwhile, the rear housing 13 is formed, at a lower portion thereof, with an oil room 13*a*, and oil contained in compressed refrigerant, which is compressed in the compression chamber 8 and discharged to the high pressure chamber, is separated by an oil separator (not shown) in the rear housing 13 to be stored in the oil room 13*a*.

In this case, oil stored in the oil room 13*a* is supplied to the rotor 2 through an oil supply passage 18 formed on one side of the rear cover 7, and the rear housing 13 is formed, at an upper portion thereof, with a discharge port 14 through which compressed refrigerant is discharged to an air conditioning system.

A space divided by the vane slot 3, the front cover 6, and the rear cover 7 constitutes a back pressure chamber 20. The vane 4 slides along the vane slot 3 by the pressure of the back pressure chamber 20 and a front end portion of the vane 4 is supported by an inner peripheral surface of the cylinder 1.

In addition, the rear cover 7 is formed with a circular arc-shaped oil groove 19 through which the back pressure chamber 20 at the rear end of the vane 4 communicates with the oil supply passage 18.

The conventional vane rotary compressor configured as described above operates as follows.

First, when the rotor 2 receives power from a drive source such as an engine and rotates along with the rotary shaft 5, low pressure refrigerant is introduced into the compression chamber 8 through the inlet 9 and compressed while the volume of the compression chamber 8 is reduced along with rotation of the rotor 2.

Then, the compressed refrigerant is discharged to the high pressure passage 12 through the outlet 10, introduced into the rear housing 13, and supplied to the air conditioning system through the discharge port 14.

In this case, oil separated by the oil separator in the upper portion of the rear housing 13 is dropped and stored into the oil room 13*a*. The stored oil is supplied to the back pressure chamber 20 at the rear end of the vane 4 via the oil supply passage 18 and the oil groove 19 so as to lubricate the vane 4.

Meanwhile, the vane 4 is pushed out along the vane slot 3 by the pressure of oil supplied to the back pressure chamber 20 and the front end portion of the vane 4 is pressed against the inner peripheral surface of the cylinder 1, thereby dividing a space between the inner peripheral surface of the cylinder 1 and an outer peripheral surface of the rotor 2 into a plurality of compression chambers 8.

In a case in which the vane 4 is configured in a linear form as the above-mentioned conventional art, high pressure oil must be continually supplied to the back pressure chamber 20 in order for the front end portion of the vane 4 to be maintained in a state of being pressed against the inner peripheral surface of the cylinder 1. Accordingly, this results in an increase in consumption power (HP) of the compressor.

In addition, excessive force is concentrated on a point at which the front end portion of the vane 4 comes into contact with the inner peripheral surface of the cylinder 1, depending upon pushing the vane 4 by the high pressure of oil in the back pressure chamber 20. Therefore, this causes an increase in torque of the rotary shaft of the compressor.

In addition, in a case in which refrigerant discharge pressure is not properly formed in the initial stage of driving the compressor, since the pressure of separated oil is low and thus force to push the vane 4 from the back pressure chamber 20 is insufficient, chattering noise is generated while the front end portion of the vane 4 discontinuously rubs against the inner peripheral surface of the cylinder 1.

Moreover, a distance by which the conventional linear vane emerges from the vane slot is limited. Accordingly, the inner peripheral surface of the cylinder has been used in a state of being restricted to a simple circle (one stroke/one rotation) as described above or an oval (two strokes/one rotation) as shown in FIG. 3.

FIG. 3 is a cross-sectional view schematically illustrating a two-stroke vane rotary compressor disclosed in Japanese Unexamined Patent Application Publication No. 2010-31759 (Patent Document 2). Here, compression and intake strokes are performed twice during one rotation of a rotor.

When a rotor 2' comes into contact with an inner peripheral surface of a cylinder 1' at two points in the oval cylinder 1' having a hollow, a compression stroke is short, thereby affecting consumption power (HP), reducing a coefficient of performance (COP) of the compressor, and directly affecting fuel efficiency of a vehicle.

In addition, similarly as described in an example of one stroke compressor of FIGS. 1 and 2, there are problems in that chattering noise is generated due to a strike of a vane 4' in the initial stage of driving the compressor, excessive force is concentrated on a point at which a front end portion of the vane 4' comes into contact with the inner peripheral surface of the cylinder 1' to thereby increase torque of a rotary shaft 5', and high pressure oil must be continually supplied to a back pressure chamber 20' to thereby increase consumption power (HP) of the compressor.

DISCLOSURE

Technical Problem

Accordingly, the present invention has been made in view of the above-mentioned problems, and an object thereof is to provide a vane rotary compressor capable of enhancing a coefficient of performance (COP) of the compressor, preventing chattering noise generated while a vane strikes an inner peripheral surface of a cylinder without being pressed against the same during operation of the compressor, and reducing a package thereof under the same capacity.

Technical Solution

In accordance with an aspect of the present invention, a vane rotary compressor includes a hollow cylinder which an inner peripheral surface thereof is formed in the form of an involute curve along a circumferential direction thereof, a front housing which is formed therein with a space portion so as to install the cylinder and is opened at the rear of the space portion, a rear housing which is coupled to a rear end of the front housing to close the space portion, a rotor which is installed within the cylinder and rotates by receiving power of a drive source from a rotary shaft, and a vane which is hinge-coupled, at one end thereof, to an outer peripheral surface of the rotor while the other end of the vane comes into contact with the inner peripheral surface of the cylinder along with rotation of the rotor.

Here, the vane may be provided in plural numbers, the plural vanes being spaced apart from each other in a circumferential direction of the rotor.

In this case, an outside surface of the vane may be formed by a curvature corresponding to the outer peripheral surface of the rotor.

In addition, the outer peripheral surface of the rotor may be formed with an accommodation groove to accommodate the vane, and when the vane is accommodated into the accommodation groove, the outside surface of the vane and the outer peripheral surface of the rotor may form a circumferential surface having the same curvature.

Meanwhile, one side of an outer peripheral surface of the front housing may protrude outwardly to form a first oil room.

In addition, one side of an outer peripheral surface of the cylinder may be recessed to form a second oil room.

Moreover, a lower end of a cylinder portion of the front housing may protrude outwardly to form a third oil room and a fourth oil room which are spaced apart from each other.

In this case, one side of the rear housing may be formed with an oil passage to guide a flow of oil from one side of the fourth oil room to a rear end of the rotary shaft.

In this case, both front and rear sides of the rotor may respectively come into contact with the front housing and the rear housing, and a plurality of rotor passages may be axially formed to penetrate the rotor, thereby allowing oil supplied through the oil passage to lubricate a rear end sliding surface of the rotor while lubricating a front end sliding surface of the rotor through the rotor passages.

Additional advantages, objects, and features of the invention will be set forth in part in the description which follows and in part will become apparent to those having ordinary skill in the art upon examination of the following or may be learned from practice of the invention.

BRIEF DESCRIPTION OF DRAWINGS

The above and other objects, features and other advantages of the present invention will be more clearly understood from the following detailed description taken in conjunction with the accompanying drawings, in which.

BEST MODE FOR INVENTION

Figure 1:
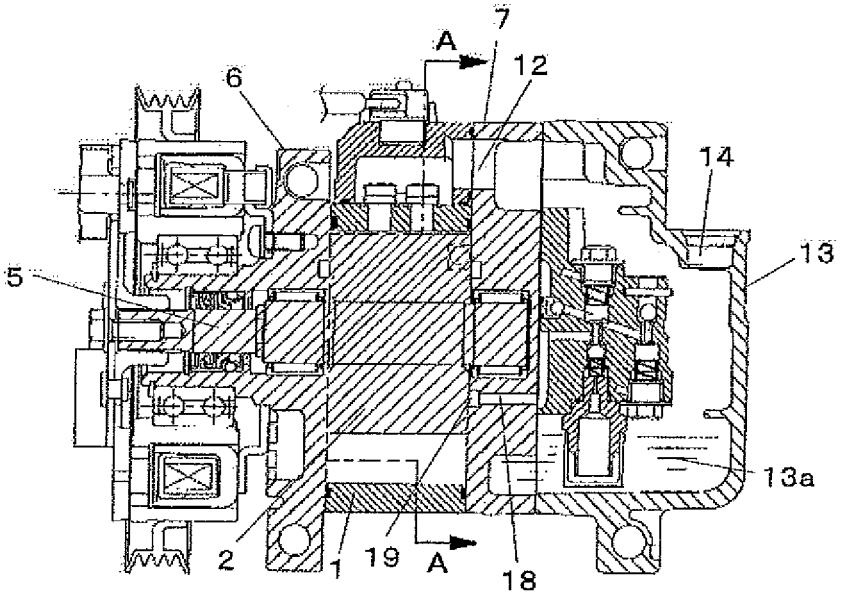
FIG. 1 PRIOR ART
FIG. 1 is a cross-sectional view schematically illustrating a conventional single-stroke vane rotary compressor.

Hereinafter, a vane rotary compressor according to exemplary embodiments of the present invention will be described in more detail with reference to the accompanying drawings. In the description, the thickness of each line or the size of each component illustrated in the drawings may be exaggerated for convenience of description and clarity.

In addition, terms to be described later are terms defined in consideration of functions of the present invention, and these may vary with the intention or practice of a user or an operator. Therefore, such terms should be defined based on the entire content disclosed herein.

In addition, the following embodiments are for the purpose of describing the components set forth in the appended claims only and are not intended to limit the spirit and scope of the invention. More particularly, various variations and modifications are possible in concrete constituent elements of the embodiments, and it is to be understood that differences relevant to the variations and modifications fall within the spirit and scope of the present disclosure defined in the appended claims.

An Embodiment

Figure 4:
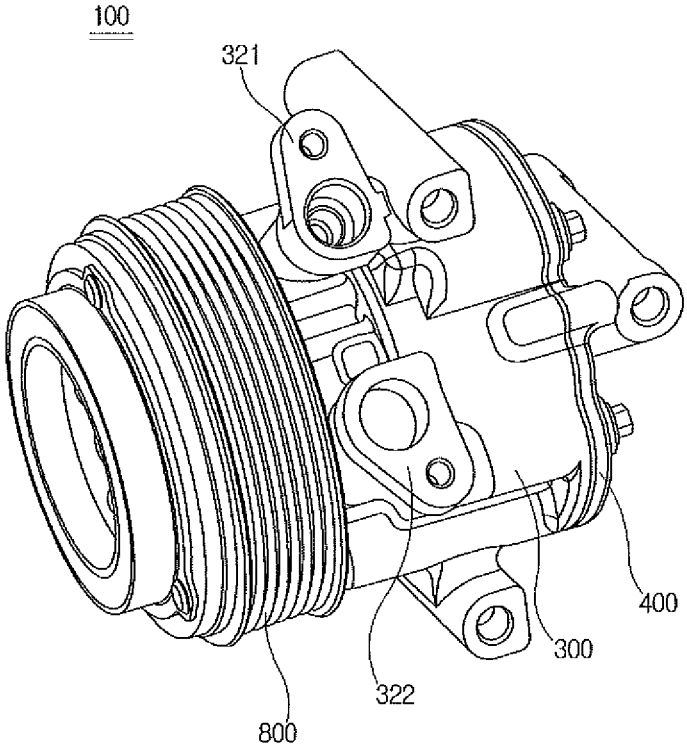
FIG. 4 is a perspective view illustrating a vane rotary compressor according to an embodiment of the present invention.
Figure 5:
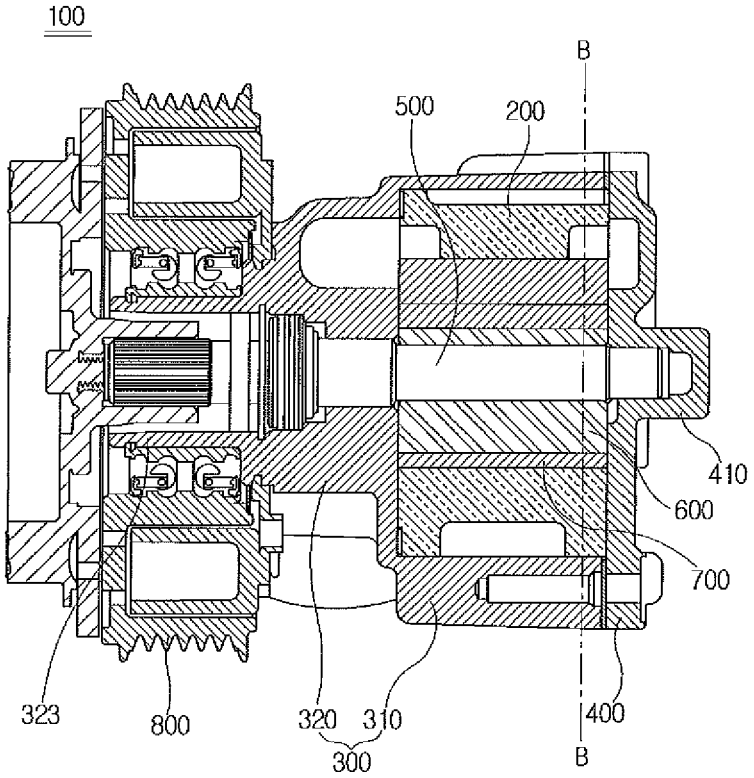
FIG. 5 is a longitudinally cross-sectional view illustrating the vane rotary compressor according to the embodiment of the present invention.

FIG. 4 is a perspective view illustrating a vane rotary compressor according to an embodiment of the present invention. FIG. 5 is a longitudinally cross-sectional view illustrating the vane rotary compressor according to the embodiment of the present invention.

As shown in FIGS. 4 and 5, a vane rotary compressor 100 according to an embodiment of the present invention includes a front housing 300 which is opened at the rear thereof so as to accommodate a cylinder 200 therein, and a rear hosing 400 which is coupled to a rear end of the front housing 300 to close an open portion of the front housing 300, thereby allowing the overall external appearance thereof to be defined.

The front housing 300 includes a cylindrical cylinder portion 310 which is formed therein with a space portion, and a head portion 320 which is formed integrally with the cylinder portion 310 in the axial front thereof to close the front of the space portion. The space portion is mounted with a hollow cylinder 200.

In this case, the cylinder 200 is mounted therein with a rotary shaft 500 which rotates by the power of a drive source, a rotor 600 which rotates along with the rotary shaft 500 by receiving rotation force from the rotary shaft 500, and a plurality of vanes 700 which are coupled on an outer peripheral surface of the rotor 600 to be capable of protruding therefrom.

In addition, the rear housing 400 is coupled to the axial rear of the front housing 300 to close the rear of the space portion.

Meanwhile, the head portion 320 of the front housing 300 is provided, on an outer peripheral surface thereof, with a suction port 321 to suck refrigerant from the outside and a discharge port 322 to discharge high pressure refrigerant compressed within the cylinder 200 to the outside, which are spaced apart from each other in a circumferential direction.

In addition, the head portion 320 is extendably formed, at a front center thereof, with a pulley coupling portion 323 so as to couple a pulley 800 of an electronic clutch (not shown).

Figure 6:
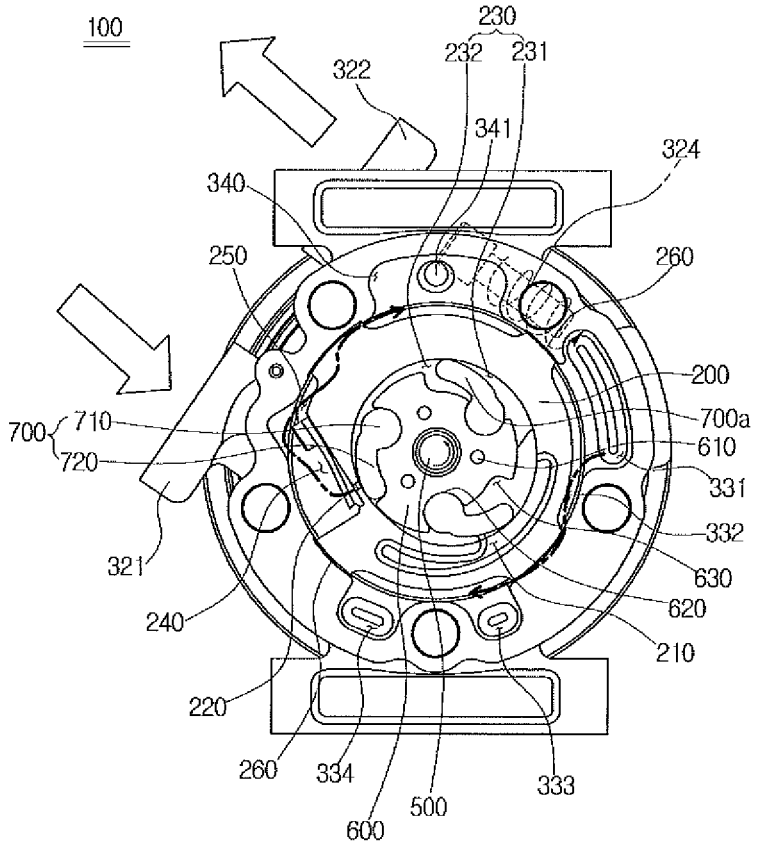
FIG. 6 is a cross-sectional view taken along line B-B in FIG. 5.

FIG. 6 is a cross-sectional view taken along line B-B in FIG. 5.

Here, the bold arrows indicated in FIG. 6 indicate suction and discharge directions of refrigerant, the solid line arrow indicates a rotation direction of the rotary shaft 500, the alternately long and short dashed line arrow indicates a flow of high-pressure compressed refrigerant, and the dotted line arrow indicates a flow of refrigerant from which oil is separated while passing through an oil separation pipe 324.

As shown in FIG. 6, the rotor 600 with the vanes 700 is inserted into and mounted in the hollow of the cylinder 200, so that the hollow of the cylinder 200 forms a compression space in which introduced refrigerant is compressed by rotation of the rotor 600.

In this case, one side of the cylinder 200 is formed with an inlet 210 and an outlet 220 each of which communicates with one side of the compression space. One side of the inlet 210 communicates with the suction port 321 of the head portion 320 and one side of the outlet 220 communicates with the discharge port 322 of the head portion 320.

Accordingly, after refrigerant sucked through the suction port 321 from the outside passes through the inlet 210 and enters the hollow of the cylinder 200, which is the compression space, to be compressed, the refrigerant passes through the outlet 220 in a high pressure state and is supplied through the discharge port 322 to the outside.

The rotor 600 is coupled to the rotary shaft 500, which is connected to an electronic clutch (not shown) driven by a drive motor (not shown) or an engine belt, to axially rotate along with the rotary shaft 500. In this case, the rotor 600 may be formed with a plurality of rotor passages 610 which axially penetrate the rotor 600.

In this case, a front end portion of each vane 700, which rotates and protrudes from the outer peripheral surface of the rotor 600, is supported by an inner peripheral surface of the cylinder 200, so that a compression chamber 230 is formed by a space defined by inner peripheral surface of the cylinder 200, the outer peripheral surface of the rotor 600, and the vane 700.

In addition, both opening portions of the compression chamber 230 are respectively coupled to the front housing 300 and the rear housing 400 so as to close the compression chamber 230 in forward and rearward directions. In this case, as shown in FIG. 5, a front surface of the rotor 600 comes into contact with the head portion 320 of the front housing 300 and a rear surface of the rotor 600 comes into contact with a front surface of the rear housing 400.

Accordingly, refrigerant introduced through the inlet 210 into the hollow of the cylinder 200 is locked in the closed compression chamber 230 and compressed by rotation of the rotor 600.

The plural vanes 700, which are spaced apart from each other along the outer peripheral surface of the rotor 600 in the circumferential direction, are provided, and thus the hollow of the cylinder 200 is divided into a plurality of compression chambers 230.

Refrigerant locked in each of the compression chambers 230 is compressed as the volume of compression chamber 230 decreases during rotation of the rotor 600. To this end, the inner peripheral surface of the cylinder 200 is formed in the form of an involute curve in which a diameter thereof gradually decreases from the inlet 210 toward the outlet 220 in the rotation direction of the rotor 600 during compression of refrigerant.

That is, in the compression rotation direction of the rotor 600, as the diameter of the inner peripheral surface of the cylinder 200 gradually decreases from the inlet 210 toward the outlet 220 along the inner peripheral surface of the cylinder 200 and a clearance between the inner peripheral surface of the cylinder 200 and the outer peripheral surface of the rotor 600 is gradually narrowed, the volume of the compression chamber 230 is reduced.

In this case, the rotor 600 is installed in the hollow of the cylinder 200 such that the inner peripheral surface of the cylinder 200 and the outer peripheral surface of the rotor 600 have equal centers when viewed in section. That is, in the involute curve which is defined along the inner peripheral surface of the cylinder 200, centers of a start point and an end point coincide with the center of the rotor 600.

Accordingly, unlike a conventional art, in accordance with the embodiment of the present invention, an eccentric shaft to rotate the rotor 600 in the cylinder 200 is not separately required. Consequently, it may be possible to prevent power loss or vibration and noise due to installation of the conventional eccentric shaft.

Figure 8:
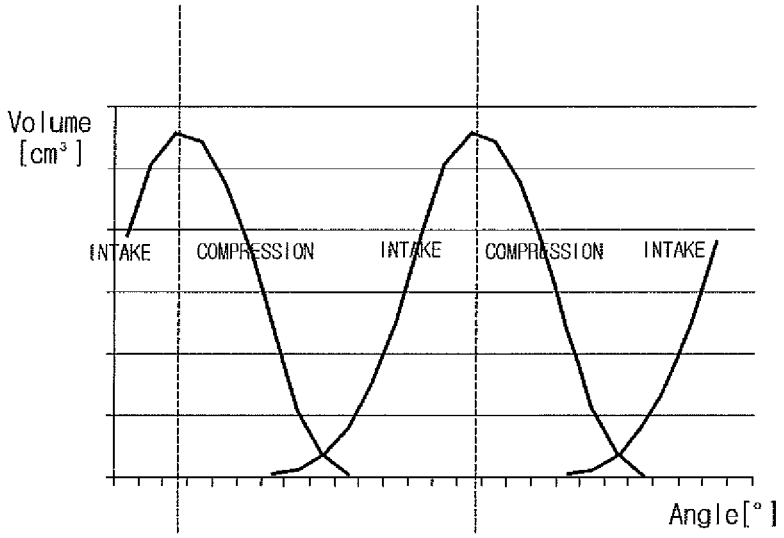
FIG. 8 PRIOR ART
FIG. 8 is a graph illustrating a change in volume of a compression chamber according to an intake stroke and a compression stroke of the conventional single-stroke vane rotary compressor.
Figure 9:
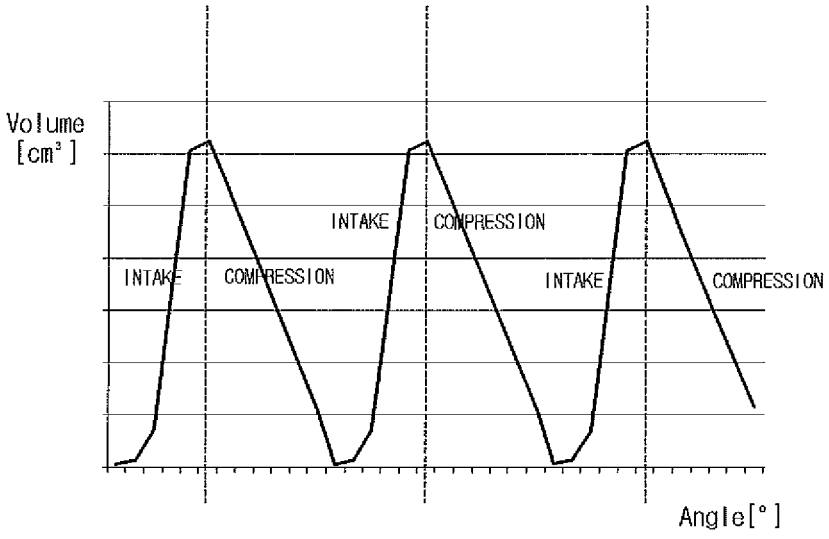
FIG. 9 is a graph illustrating a change in volume of a compression chamber according to an intake stroke and a compression stroke of the vane rotary compressor according to the embodiment of the present invention.

FIGS. 8 and 9 are graphs respectively illustrating a change in volume of the compression chamber according to an intake stroke and a compression stroke of a conventional single-stroke vane rotary compressor and the vane rotary compressor according to the embodiment of the present invention.

Figure 2:
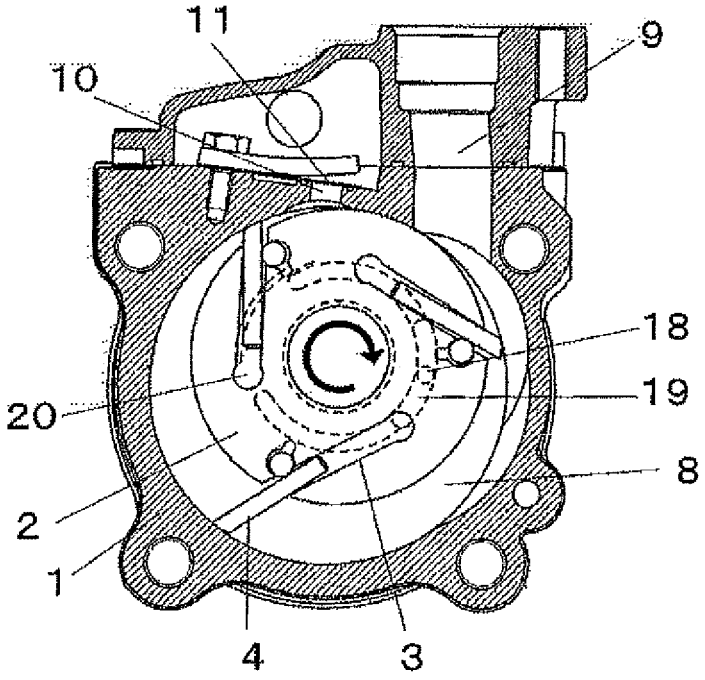
FIG. 2 PRIOR ART
FIG. 2 is a cross-sectional view taken along line A-A in FIG. 1.
Figure 3:
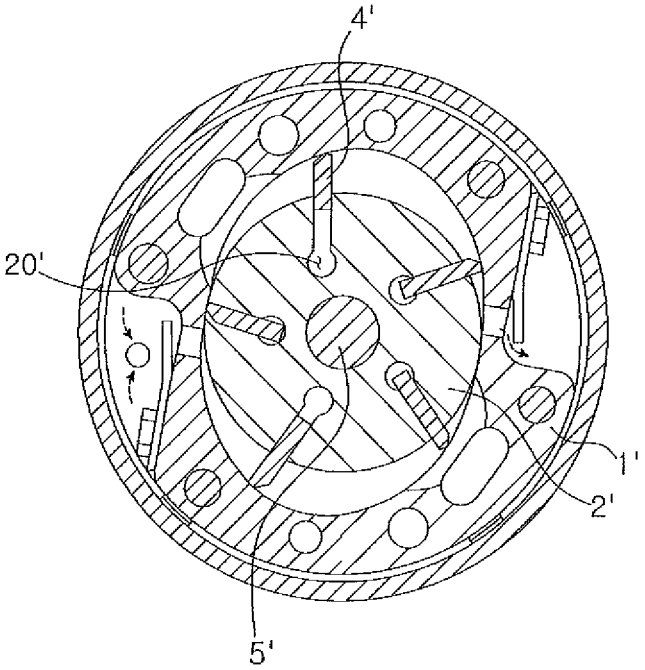
FIG. 3 PRIOR ART
FIG. 3 is a cross-sectional view illustrating a conventional two-stroke vane rotary compressor.

As shown in FIG. 8, in an example to which a circular cylinder having a conventional single-stroke (one stroke/one rotation, see FIG. 2) is applied, it can be seen that the intake stroke and the compression stroke are approximately 5.5 versus 4.5 and the intake stroke is slightly long. Indeed, the intake stroke may be significantly longer than the compression stroke, considering that the outlet is formed at a compression end section prior to a compression end point instead of being not accurately formed at the compression end point due to difficulty of the passage formation. This is similarly applied to a conventional oval cylinder (two strokes/one rotation, see FIG. 9).

On the other hand, in a case of applying the involute cylinder as the embodiment of the present invention shown in FIG. 6, the compression stroke may increase compared to the intake stroke as shown in FIG. 9, thereby enabling consumption power (HP) to be reduced.

In addition, as one side of the outer peripheral surface of the rotor 600 continuously comes into contact with one side of the inner peripheral surface of the cylinder 200, it may be possible to decrease a loss due to inner leakage by a reduction in pressure differential between the compression chambers 230 and to enhance compression efficiency together with a reduction in consumption power.

The vane 700 is hinge-coupled, at one end thereof, to one side of the outer peripheral surface of the rotor 600 to form a cantilever shape. In this case, the vane 700 includes a hinge portion 710 which is hinge-coupled to one side of the outer peripheral surface of the rotor 600 and a blade portion 720 extending from hinge portion 710.

Here, the hinge portion 710 of the vane 700 is hinge-coupled to one side of the outer peripheral surface of the rotor 600. For example, an insertion groove 620 is formed on one side of the outer peripheral surface of the rotor 600, and the hinge portion 710 may be rotatably inserted into the insertion groove 620. In this case, when the hinge portion 710 is inserted into the insertion groove 620, the hinge portion 710 is preferably prevented from being decoupled therefrom in a radial direction of the rotor 600.

The blade portion 720 of the vane 700 extends from the hinge portion 710 to one direction, and an outside surface of the blade portion 720 facing the inner peripheral surface of the cylinder 200 preferably has a curvature corresponding to a shape of the outer peripheral surface of the rotor 600.

This enables the outside surface of the blade portion 720 of the vane 700 to come into contact with the inner peripheral surface of the cylinder 200 at a point at which the outer peripheral surface of the rotor 600 comes into contact with the inner peripheral surface of the cylinder 200. To this end, an accommodation groove 630 to accommodate the blade portion 720 of the vane 700 is formed on the outer peripheral surface of the rotor 600, and the accommodation groove 630 is formed in the same number as that of the vanes 700 in the circumferential direction.

In this case, when the blade portion 720 of each vane 700 is fully accommodated into the accommodation groove 630, the accommodation groove 630 is preferably formed such that the outside surface of the blade portion 720 forms a curved surface having the same curvature with the outer peripheral surface of the rotor 600. That is, it is preferable that a shape of a bottom surface of the accommodation groove 630 corresponds to a shape of an inside surface of the blade portion 720 and a depth of the accommodation 630 corresponds to a thickness of the blade portion 720.

In this case, the cantilever vane 700 is fully accommodated into the accommodation groove 630 of the rotor 600 at the compression end point, so that a change in volume of the compression chamber 230 is maximized. Consequently, due to an improvement in compression efficiency, in a case configured as the same package, a capacity of the compressor may be increased to the same volumes as those of the accommodation grooves 630, compared with a conventional example to which a tinier vane is applied. Furthermore, the overall package may be reduced under the same capacity, compared with a conventional example.

In the vane 700, since the hinge portion 710 is rotatably hinge-coupled to one side of the outer peripheral surface of the rotor 600, the blade portion 720 is spread by rotating outward of the rotor 600 about the hinge portion 710 by centrifugal force generated during rotation of the rotor 600 and pressure of refrigerant locked in the compression chamber 230.

Accordingly, unlike an example to which a conventional linear vane is applied, since a separate back pressure chamber to push the vane 700 toward the inner peripheral surface of the cylinder 200 is not required on one side of the rotor 600, it may be possible to reduce an overall package of the compressor by decreasing an outer diameter of the rotor 600.

Figure 10:
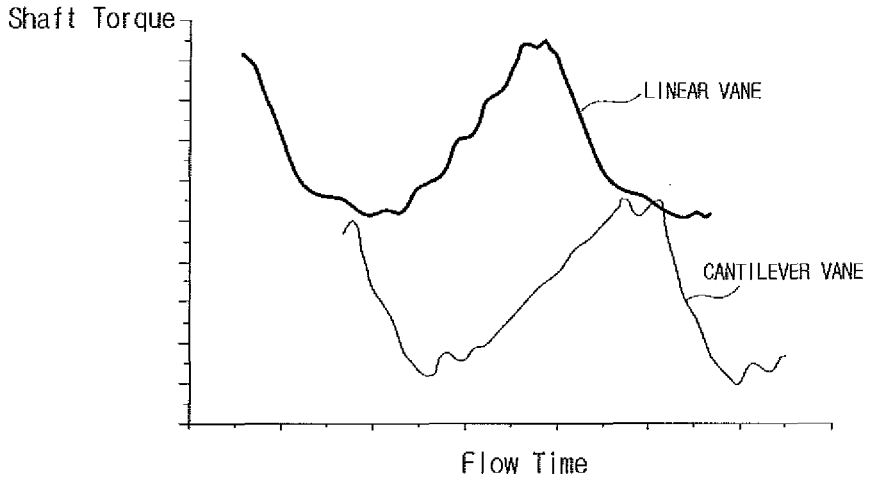
FIG. 10 is a graph comparing torque of a rotary shaft of the compressor when a conventional linear vane and a cantilever vane according to the embodiment of the present invention are applied thereto.

In addition, it may be possible to prevent torque of the rotary shaft of the compressor from increasing while excessive force is concentrated on a point at which the front end portion of the vane comes into contact with the inner peripheral surface of the cylinder due to the high pressure of the conventional back pressure chamber. That is, as identified in FIG. 10, torque of the rotary shaft of the compressor is further lowered when the cantilever vane according to the embodiment of the present invention is applied to the compressor, compared with the conventional linear vane.

In addition, since oil need not be supplied to the back pressure chamber in order to push the vane, an injection amount of oil in the compressor decreases to thereby achieve a reduction in costs and a circulation amount of oil which adversely affects performance of a heat exchanger decreases. As a result, it may be possible to enhance overall performance of an air conditioning system.

Furthermore, since a change in volume increases in the process of spreading the cantilever vane 700, during suction of refrigerant a change in pressure increases and a flow velocity of a fluid increases, thereby enhancing the capacity and performance of the compressor by a flow increase, compared with an example to which the conventional linear vane is applied.

Meanwhile, a tip of the spread blade portion 720 of the vane 700 is pressed against the inner peripheral surface of the cylinder 200 to close the compression chamber 230, and moves along the inner peripheral surface of the cylinder 200 along with rotation of the rotor 600.

In this case, since the inner peripheral surface of the cylinder 200 is formed in the form of the involute curve, the clearance between the inner peripheral surface of the cylinder 200 and the outer peripheral surface of the rotor 600 is gradually narrowed from the inlet 210 toward the outlet 220, and the spread angle of the blade portion 720 of the vane 700 is gradually reduced and folded. Consequently, since the outside surface of the blade portion 720 pressed against the inner peripheral surface of the cylinder 200 forms a curved surface, tightness by the cylinder 200 and the vane 700 is improved.

Subsequently, the blade portion 720 of the vane 700 is fully folded and accommodated into the accommodation groove 630 of the rotor 600 at a point at which the outer peripheral surface of the rotor 600 comes into contact with the inner peripheral surface of the cylinder 200, and the outside surface of the vane 700 comes into contact with the inner peripheral surface of the cylinder 200.

In this case, the blade portion 720 preferably extends in the rotation direction of the rotor 600 for compression of refrigerant. In this case, it may be possible to prevent leakage of refrigerant in the compression chamber 230 using a pressure differential between two compression chambers 230 adjacent to both sides of one vane 700.

As for an example shown in FIG. 6, a first compression chamber 231 which is close to the inlet 210 and a second compression chamber 232 which is relatively away from the inlet 210 and close to the outlet 220 in the rotation direction of the rotor 600 are respectively adjacent to both sides of a reference vane 700*a*.

In more detail, an inside surface of a blade portion 720 of the reference vane 700*a* comes into contact with the second compression chamber 232, and an outside surface of the blade portion 720 of the reference vane 700*a* comes into contact with the first compression chamber 231.

In this case, since a compression stroke in the second compression chamber 232 further progresses compared to the first compression chamber 231, a pressure acting on the inside of the second compression chamber 232 by refrigerant is larger than a pressure acting on the inside of the first compression chamber 231.

That is, a larger pressure acts on the inside surface of the blade portion 720 of the reference vane 700*a* coming into contact with the second compression chamber 232, compared to the outside surface of the blade portion 720 of the reference vane 700*a* coming into contact with the first compression chamber 231.

By such a pressure differential, the blade portion 720 of the reference vane 700*a* is forced toward the inner peripheral surface of the cylinder 200 and the front end portion of the blade portion 720 is continually maintained in a state of being supported by the inner peripheral surface of the cylinder 200.

Accordingly, when an air conditioning system such as an air conditioner of a vehicle is in an idle state (low RPM, high pressure), the blade portion 720 of the vane 700 is maintained in a state of being pressed against the inner peripheral surface of the cylinder 200 by a pressure differential of refrigerant filled in each compression chamber 230. Consequently, it may be possible to prevent leakage of refrigerant and chattering noise such as tapping sound due to spread of the vane 700 during starting.

Meanwhile, a discharge portion 240, from which high-pressure compressed refrigerant is discharged, is recessed on one side of the outer peripheral surface of the cylinder 200. The discharge portion 240 is penetratively formed, at one side thereof, with a plurality of outlets 220 which communicates with the compression chambers 230, whereas is formed, at the other side thereof, with a guide passage 250 to guide high pressure refrigerant toward the discharge port 322.

In this case, a muffler space 340 for reducing pulsation and discharge noise is formed in one side of the guide passage 250. The muffler space 340 is formed to protrude from one side of an outer peripheral surface of the cylinder portion 310, and one side of the muffler space 340 is penetratively formed with a discharge hole 341 which communicates with the discharge port 322.

Accordingly, after pulsation and noise are reduced while high pressure refrigerant discharged to the discharge portion 240 through the outlet 220 is introduced into the muffler space 340 along the guide passage 250, the refrigerant flows toward the discharge port 322 through the discharge hole 341.

Oil contained in refrigerant is separated below the oil separation pipe 324 while high pressure refrigerant passing through the discharge hole 341 circles around along an outer peripheral surface of the oil separation pipe 324 installed within the discharge port 322. The separated oil is stored in a first oil room 331 which protrudes outwardly from the outer peripheral surface of the cylinder portion 310 of the front housing 300.

In this case, one side of the first oil room 331 is formed with a second oil room 332 communicating with the first oil room 331. The outer peripheral surface of the cylinder 200 at a lower side of the first oil room 331 is recessed in a predetermined shape to form the second oil room 332.

A third oil room 333 and a fourth oil room 334 are formed below the second oil room 332. The third oil room 333 and the fourth oil room 334 are spaced apart from each other at the lower end of the cylinder portion 310 of the front housing 300 and respectively protrude outward of the outer peripheral surface.

In this case, the outer peripheral surface of the cylinder 200 facing the third oil room 333 and the fourth oil room 334 is formed with a recessed area, and the third oil room 333 and the fourth oil room 334 communicate with each other through the recessed area.

In addition, the third oil room 333 communicates through a clearance between the outer peripheral surface of the cylinder 200 and the inner peripheral surface of the cylinder portion 310 of the front housing 300. Accordingly, oil stored in the first oil room 331 flows to the third oil room 333 and the fourth oil room 334 via the second oil room 332.

Here, the discharge portion 240, the guide passage 250, and the muffler space 340 form a high pressure chamber in which high pressure refrigerant flows in the vane rotary compressor 100. The high pressure chamber is formed in one side of the cylinder portion 310, namely in one side of a space between the cylinder portion 310 and the cylinder 200.

In addition, each of the oil rooms 331 to 334, which is a relatively low pressure area, is formed in the other side of the space between the cylinder portion 310 and the cylinder 200. In this case, the high pressure chamber and each of the oil rooms 331 to 334 are divided by a contact surface 260 on which the outer peripheral surface of the cylinder 200 comes into close contact with the inner peripheral surface of the cylinder portion 310.

That is, in the vane rotary compressor 100 according to the embodiment of the present invention, since the oil room formed in the rear housing 13 (see FIG. 1) in the related art is formed in the cylinder portion 310 of the front housing 300 together with the high pressure chamber, it may be possible to compactly configure a package of the compressor. In this case, an upper space between the cylinder portion 310 of the front housing 300 and the cylinder 200 is generally utilized as the high pressure chamber, whereas a lower space between the cylinder portion 310 and the cylinder 200 is utilized as the oil rooms 331 to 334.

Figure 7:
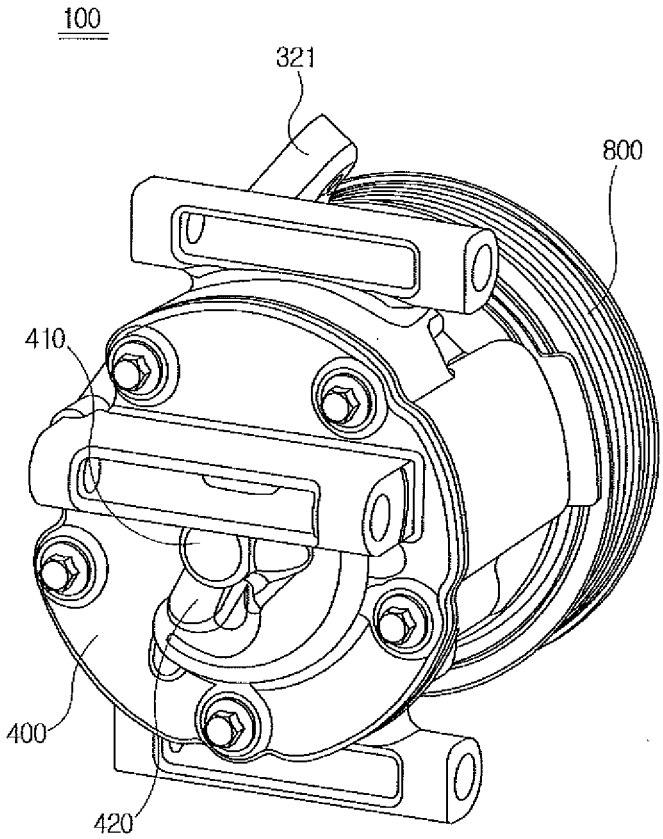
FIG. 7 is a perspective view illustrating the vane rotary compressor according to the embodiment of the present invention, when viewed from the rear.

FIG. 7 is a perspective view illustrating the vane rotary compressor according to the embodiment of the present invention, when viewed from the rear.

The rear housing 400 according to the embodiment of the present invention is coupled to the rear of the front housing 300 to close the space portion in the axial rear of the cylinder portion 310.

In this case, the rear housing 400 is formed, at a center of an outer side surface thereof, with a shaft receiving portion 410 protruding outwards so that the rear end of the rotary shaft 500 is rotatably inserted into and mounted to the shaft receiving portion 410.

Meanwhile, oil stored in the fourth oil room 334 flows to the shaft receiving portion 410 to lubricate the rotor 600 and the vane 700 together with the rotary shaft 500. To this end, one side of the shaft receiving portion 410 of the rear housing 400 is formed with an oil passage 420 which communicates, at one side thereof, with the fourth oil room 334 while communicating, at the other side thereof, with the shaft receiving portion 410.

Consequently, oil introduced into the shaft receiving portion 410 through the oil passage 420 flows rearward of the rotor 600 along the outer peripheral surface of the rotary shaft 500, and lubricates a sliding surface between the rotor 600 and the rear housing 400 while being spread radially outwards by rotation of the rotor 600.

In this case, oil flows forward of the rotor 600 through the rotor passage 610 and lubricates a sliding surface between the rotor 600 and the front housing 300. Accordingly, lubrication of the vane 700 is also performed in the process in which oil flows through the insertion groove 620 and the accommodation groove 630.

In a case of a compressor to which a conventional linear vane is applied, covers 6 and 7 (see FIG. 1) having separate oil supply passages should be disposed in the forward and rearward directions of the cylinder in order to supply high pressure oil to the back pressure chamber to push the vane, so that an overall length of the compressor is long.

However, in a case of the vane rotary compressor 100 according to the embodiment of the present invention, since the low pressure oil passage 420 is sufficient to lubricate the vane 700 as described above, it may be possible to minimize the compressor.

Various embodiments have been described in the best mode for carrying out the invention.

INDUSTRIAL APPLICABILITY

In accordance with a vane rotary compressor according to an embodiment of the present invention, as a cantilever vane is fully accommodated on an outer peripheral surface of a rotor at a compression end point to maximize a change in volume of a compression chamber, a compression ratio may be improved.

In addition, an accommodation groove of the cantilever vane is present in the compression chamber. Accordingly, in a case configured as the same package, a capacity of the compressor may be increased to the same volume as that of the accommodation groove to accommodate the cantilever vane, compared with a conventional example to which a linier vane is applied. Furthermore, the package may be reduced under the same capacity, compared with a conventional art.

In addition, since the change in volume increases during suction of refrigerant in the process of spreading the cantilever vane, a change in pressure increases and a flow velocity of a fluid increases, thereby enhancing the capacity and performance of the compressor.

In addition, since an inner peripheral surface of a cylinder is configured in the form of an involute curve, it may be possible to reduce consumption power (HP) by increasing a compression stroke compared to an intake stroke, to decrease inner leakage due to a reduction in pressure differential between the respective compression chambers, and to improve a coefficient of performance (COP) of the compressor according to optimization of intake and compression strokes.

In addition, since the cantilever vane is maintained in a state in which a front end portion of the vane is pressed against the inner peripheral surface of the cylinder by centrifugal force and a pressure differential between the compression chambers, it may be possible to prevent chattering noise due to a strike of the vane as in a conventional art.

In addition, since a back pressure chamber as in a conventional art is not formed in the rotor, it may be possible to prevent torque of a rotary shaft of the compressor from increasing while excessive force is concentrated on a point at which the vane comes into contact with the cylinder due to the high pressure of the back pressure chamber, and to reduce an overall package of the compressor by decreasing an outer diameter of the rotor.

Furthermore, since oil need not be supplied to the back pressure chamber in order to push the vane, an injection amount of oil in the compressor decreases to thereby achieve a reduction in costs and a circulation amount of oil which adversely affects performance of a heat exchanger decreases. As a result, it may be possible to enhance overall performance of an air conditioning system.

Although the present invention has been described with respect to the illustrative embodiments, it will be apparent to those skilled in the art that various variations and modifications may be made without departing from the spirit and scope of the invention as defined in the following claims.

The invention claimed is:

1. A vane rotary compressor comprising:

a hollow cylinder (200), an inner peripheral surface of the hollow cylinder is formed in the form of an involute curve along a circumferential direction of the hollow cylinder;

a front housing (300) which is formed therein with a space portion so as to install the cylinder (200) and is opened at the rear of the space portion;

a rear housing (400) which is coupled to a rear end of the front housing (300) to close the space portion;

a rotor (600) which is installed within the cylinder (200) and rotates by receiving power of a drive source from a rotary shaft (500); and a vane (700) which is hinge-coupled, at a first end of the vane, to an outer peripheral surface of the rotor (600) while a second end of the vane (700) comes into contact with the inner peripheral surface of the cylinder (200) along with rotation of the rotor (600), wherein one side of an outer peripheral surface of the front housing (300) protrudes outwardly to form an oil room (331).

2. The vane rotary compressor according to claim 1, wherein the vane (700) is provided in plural numbers, the plural vanes (700) being spaced apart from each other in a circumferential direction of the rotor (600).

3. The vane rotary compressor according to claim 1, wherein an outside surface of the vane (700) is formed by a curvature corresponding to the outer peripheral surface of the rotor (600).

4. The vane rotary compressor according to claim 3, wherein the outer peripheral surface of the rotor (600) is formed with an accommodation groove (630) to accommodate the vane (700), and when the vane (700) is accommodated into the accommodation groove (630), the outside surface of the vane (700) and the outer peripheral surface of the rotor (600) form a circumferential surface having the same curvature.

5. A vane rotary compressor comprising:

a hollow cylinder (200), an inner peripheral surface of the hollow cylinder is formed in the form of an involute curve along a circumferential direction of the hollow cylinder;

a front housing (300) which is formed therein with a space portion so as to install the cylinder (200) and is opened at the rear of the space portion;

a rear housing (400) which is coupled to a rear end of the front housing (300) to close the space portion;

a rotor (600) which is installed within the cylinder (200) and rotates by receiving power of a drive source from a rotary shaft (500); and a vane (700) which is hinge-coupled, at a first end of the vane, to an outer peripheral surface of the rotor (600) while a second end of the vane (700) comes into contact with the inner peripheral surface of the cylinder (200) along with rotation of the rotor (600), wherein one side of an outer peripheral surface of the cylinder (200) is recessed to form an oil room (332).

6. The vane rotary compressor according to claim 5, wherein the vane (700) is provided in plural numbers, the plural vanes (700) spaced apart from each other in a circumferential direction of the rotor (600).

7. The vane rotary compressor according to claim 5, wherein an outside surface of the vane (700) is formed by a curvature corresponding to the outer peripheral surface of the rotor (600).

8. The vane rotary compressor according to claim 7, wherein the outer peripheral surface of the rotor (600) is formed with an accommodation groove (630) to accommodate the vane (700), and when the vane (700) is accommodated into the accommodation groove (630), the outside surface of the vane (700) and the outer peripheral surface of the rotor (600) form a circumferential surface having the same curvature.

9. A vane rotary compressor comprising:

a hollow cylinder (200), an inner peripheral surface of the hollow cylinder is formed in the form of an involute curve along a circumferential direction of the hollow cylinder;

a front housing (300) which is formed therein with a space portion so as to install the cylinder (200) and is opened at the rear of the space portion;

a rear housing (400) which is coupled to a rear end of the front housing (300) to close the space portion;

a rotor (600) which is installed within the cylinder (200) and rotates by receiving power of a drive source from a rotary shaft (500); and a vane (700) which is hinge-coupled, at a first end of the vane, to an outer peripheral surface of the rotor (600) while a second end of the vane (700) comes into contact with the inner peripheral surface of the cylinder (200) along with rotation of the rotor (600), wherein a lower end of a cylinder portion (310) of the front housing (300) protrudes outwardly to form a pair of oil rooms (333) (334), the pair of oil rooms (333) (334) spaced apart from each other.

10. The vane rotary compressor according to claim 9, wherein one side of the rear housing (400) is formed with an oil passage (420) to guide a flow of oil from one side of one of the pair of oil rooms (333) (334) to a rear end of the rotary shaft (500).

11. The vane rotary compressor according to claim 10, wherein both front and rear sides of the rotor (600) respectively come into contact with the front housing (300) and the rear housing (400), and a plurality of rotor passages (610) axially formed to penetrate the rotor (600), thereby allowing oil supplied through the oil passage (420) to lubricate a rear end sliding surface of the rotor (600) while lubricating a front end sliding surface of the rotor (600) through the rotor passages (610).

12. The vane rotary compressor according to claim 9, wherein the vane (700) is provided in plural numbers, the plural vanes (700) spaced apart from each other in a circumferential direction of the rotor (600).

13. The vane rotary compressor according to claim 9, wherein an outside surface of the vane (700) is formed by a curvature corresponding to the outer peripheral surface of the rotor (600).

14. The vane rotary compressor according to claim 13, wherein the outer peripheral surface of the rotor (600) is formed with an accommodation groove (630) to accommodate the vane (700), and when the vane (700) is accommodated into the accommodation groove (630), the outside surface of the vane (700) and the outer peripheral surface of the rotor (600) form a circumferential surface having the same curvature.

* * * * *